US006974371B2

(12) United States Patent
Chen et al.

(10) Patent No.: US 6,974,371 B2
(45) Date of Patent: Dec. 13, 2005

(54) TWO PART RETAINING RING

(75) Inventors: Hung Chih Chen, Santa Clara, CA (US); Jeonghoon Oh, Sunnyvale, CA (US); Steven M. Zuniga, Soquel, CA (US); Robert D. Tolles, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 11 days.

(21) Appl. No.: 10/427,750

(22) Filed: Apr. 30, 2003

(65) Prior Publication Data

US 2004/0219870 A1 Nov. 4, 2004

(51) Int. Cl.[7] ..... B24B 47/02
(52) U.S. Cl. ..... 451/398; 451/285
(58) Field of Search ..... 451/422, 397, 451/398, 285, 286, 287, 288, 289

(56) References Cited

U.S. PATENT DOCUMENTS

| | | | | |
|---|---|---|---|---|
| 5,205,082 A | | 4/1993 | Shendon et al. | |
| 5,423,558 A | | 6/1995 | Koeth et al. | |
| 5,584,751 A | | 12/1996 | Kobayashi et al. | |
| 5,605,488 A | | 2/1997 | Ohashi et al. | |
| 5,635,083 A | | 6/1997 | Breivogel et al. | |
| 5,643,053 A | | 7/1997 | Shendon | |
| 5,643,061 A | | 7/1997 | Jackson et al. | |
| 5,645,474 A | | 7/1997 | Kubo et al. | |
| 5,647,789 A | | 7/1997 | Kitta et al. | |
| 5,695,392 A | | 12/1997 | Kim | |
| 5,759,918 A | | 6/1998 | Hoshizaki et al. | |
| 5,851,140 A | | 12/1998 | Barns et al. | |
| 6,068,548 A | * | 5/2000 | Vote et al. | 451/398 |
| 6,186,880 B1 | * | 2/2001 | Gonzalez et al. | 451/397 |
| 6,206,768 B1 | * | 3/2001 | Quek | 451/287 |
| 6,277,008 B1 | | 8/2001 | Masuta et al. | |
| 6,354,927 B1 | * | 3/2002 | Natalicio | 451/287 |
| 2004/0065412 A1 | | 4/2004 | Ensinger | |
| 2004/0067723 A1 | | 4/2004 | Ensinger | |

FOREIGN PATENT DOCUMENTS

| | | |
|---|---|---|
| EP | 0 747 167 A2 | 12/1996 |
| EP | 0 776 730 A1 | 6/1997 |
| EP | 0 790 100 A1 | 8/1997 |
| EP | 0 841 123 A1 | 5/1998 |
| EP | 0 988 931 A2 | 3/2000 |
| GB | 2 307 342 A | 5/1997 |
| GB | 2 336 121 A | 10/1999 |

OTHER PUBLICATIONS

"High–Tech Resins Boost Chip Production", Machine Design, Nov. 7, 1996, pp 52+. ["Machine Design"].

"Advanced Engineering Plastics for the Semiconductor Industry", DSM Engineering (Polymer Corporation), 1996. ["DSM"].

"Advanced Engineering Plastics for the Semiconductor Industry", DSM Engineering (Polymer Corporation), 1997. ["DSM"].

* cited by examiner

*Primary Examiner*—Dung Van Nguyen
(74) *Attorney, Agent, or Firm*—Fish & Richardson PC

(57) ABSTRACT

A retaining ring is made of two generally annual portions. One portion has depressions and the other portion has projections that extend into the depressions when the two portions are brought together. The projections can have a cross section with two outwardly sloped sides.

41 Claims, 3 Drawing Sheets

FIG._3A
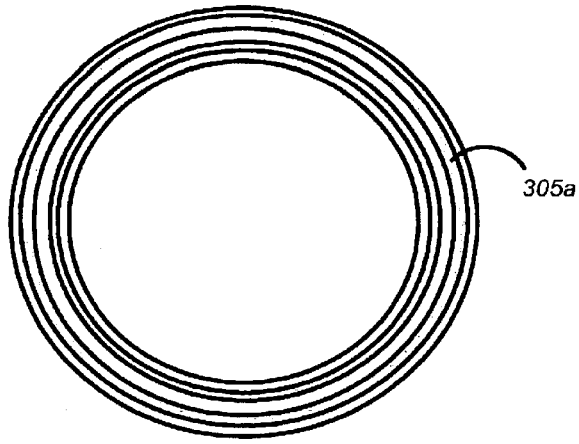
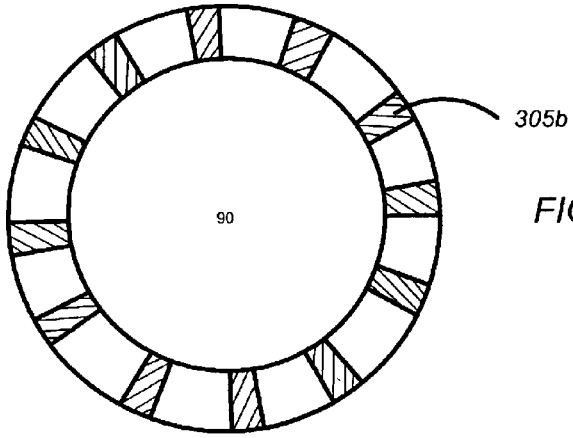
FIG._3B
FIG._3C
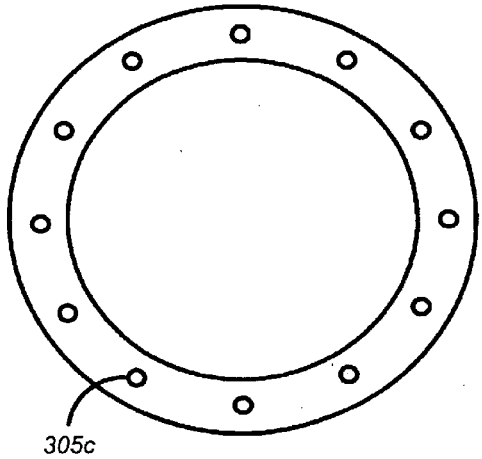

TWO PART RETAINING RING

TECHNICAL FIELD

This invention relates generally to chemical mechanical polishing of substrates, and more particularly to a retaining ring for use in chemical mechanical polishing.

BACKGROUND

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head of a CMP apparatus. The exposed surface of the substrate is placed against a rotating polishing disk pad or belt pad. The polishing pad can be either a standard pad or a fixed-abrasive pad. A standard pad has a durable roughened surface, whereas a fixed-abrasive pad has abrasive particles held in a containment media. The carrier head provides a controllable load on the substrate to push it against the polishing pad. The carrier head has a retaining ring which holds the substrate in place during polishing. A polishing slurry, including at least one chemically-reactive agent, and abrasive particles if a standard pad is used, is supplied to the surface of the polishing pad.

SUMMARY

In one aspect, the invention is directed to a retaining ring that is made of two generally annual portions. One portion has depressions and the other portion has projections that extend into the depressions when the two portions are brought together. The projections may have a cross section with two outwardly sloped sides.

In another aspect, the invention is directed to retaining ring having a generally annual first portion having a surface with one or more depressions, and a generally annual second portion with one or more projections that extend into the one or more depressions of the first portion when the first and second portions are brought together. The projections have a cross section with two outwardly sloped sides.

Implementations of the invention may include one or more of the following features. The sides of the projections can have an angle of between 10° and 70°. The base of a depression can be wider than the neck of the depression. The geometry of the projection can be similar to the geometry of the depression. The width of a projection can be less than the width of its corresponding depression. The one or more depressions can be annular grooves, axial grooves, or discrete features distributed at equal angular intervals around the second portion. The two rings can be adhesively bonded to one another, e.g., with an epoxy, or connected together with fasteners. The first portion can contact the second portion either in the area where there are no projections, or at the projections. The portions can each have both depressions and projections. The projections have a dovetail shaped cross section.

In another aspect, the invention is directed to a retaining ring that has a generally annular first portion and a generally annular second portion in contact with the first portion. An interface between the first and second portions includes one or more interlock structures having a dovetail shaped cross section.

In another aspect, the invention is directed to a retaining ring that has a generally annular first portion having a bottom surface to contact a polishing pad and a generally annular second portion joined to the first portion and having a top surface to be secured to a carrier head. One of the first and second portions includes a recess and another of the first and second portions includes a projection that extends into the recess.

In another aspect, the invention is directed to a method of making a retaining ring. A generally annular first portion is formed having a surface with one or more depressions, a generally annular second portion is formed with one or more projections that have a cross section with two outwardly sloped sides, an adhesive layer is disposed on either the first or second portion, and bringing the first and second portions into contact such that the projections extend into the depressions and the adhesive layer is between the first and second portions.

Implementations of the invention may include one or more of the following advantages. An interlock structure may connect the two parts of the retaining ring. The side load created during polishing can be borne by the interlock structure rather than the adhesive bond between the two parts. By removing the side load stress from the adhesive bond, the risk of adhesive delamination can be reduced.

Another potential advantage is that the projections and depressions can increase the surface area of the two rings on the surfaces that are connected to one another. The increased surface area may commensurately increase the bonding area where an adhesive is placed, and thus may strengthen the adhesion between the two rings.

Yet another potential advantage of the invention is that the angle of the features is such that a material can be placed inside the feature easily, while the angle is still able to create an interlock feature. Further, the projections can be sufficiently thick enough to reduce the risk of breakage. If the features are in direct contact with one another, the two rings can be machined so that the adhesive layer between the rings is a consistent thickness.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 3A shows an example of the arrangement of features on a surface of a retaining ring, where the features are shaped as concentric circles.

FIG. 3B shows an example of the arrangement of features on a surface of a retaining ring, where the features are distributed at equally distanced intervals around the ring.

FIG. 3C shows an example of the arrangement of features on a surface of a retaining ring, where the features are axially aligned grooves.

Like reference symbols in the various drawings indicate like elements.

DETAILED DESCRIPTION

Figure 1:
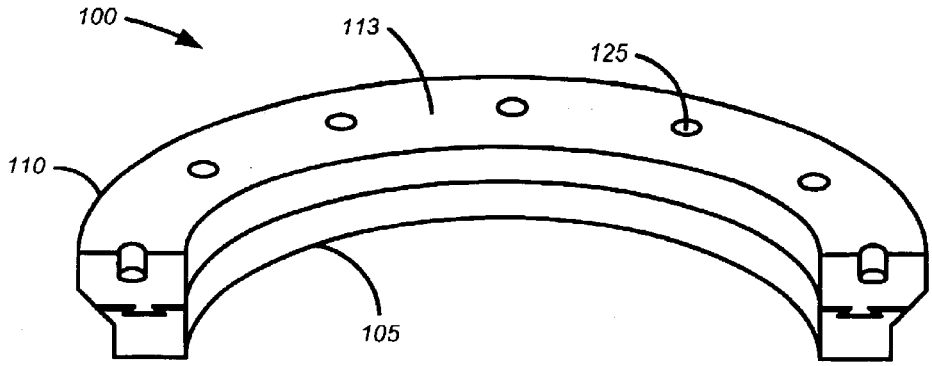
FIG. 1 shows a perspective, partially cross-sectional view of a retaining ring according to the present invention.
Figure 2:
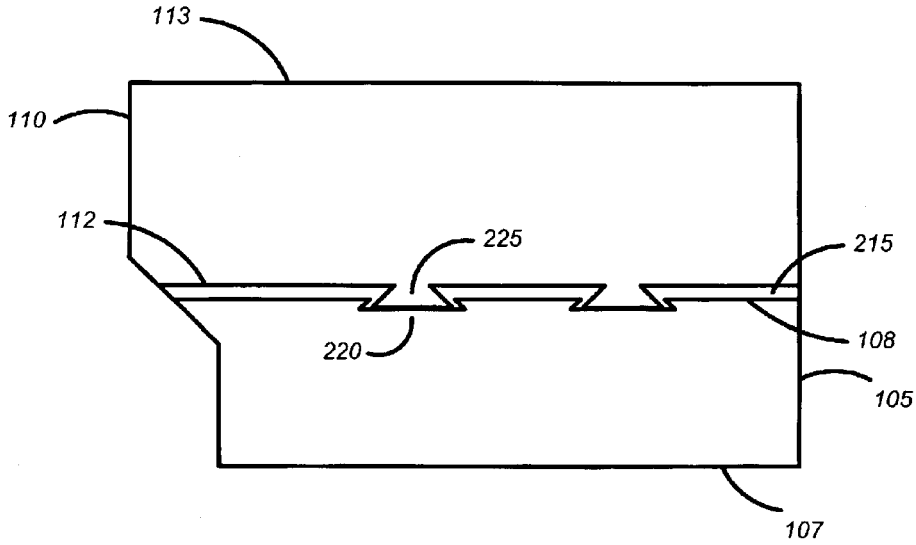
FIG. 2 shows a cross-section of one implementation of a retaining ring according to the present invention.

As shown in FIGS. 1 and 2, a retaining ring 100 is a generally an annular ring that can be secured to a carrier head of a CMP apparatus. A suitable CMP apparatus is described in U.S. Pat. No. 5,738,574 and a suitable carrier head is described in U.S. Pat. No. 6,251,215, the entire disclosures of which are incorporated herein by reference. The retaining ring holds a substrate within the recess of the ring during polishing.

A retaining ring can be constructed from two rings, including a lower ring 105 and an upper ring 110. The lower ring 105 has a lower surface 107 that can be brought into contact with a polishing pad, and an upper surface 108. The lower ring 105 can be formed of a material which is chemically inert in a CMP process, such as polyphenylene sulfide (PPS), polyetheretherketone (PEEK), carbon filled PEEK, Teflon® filled PEEK, polyethylene terephthalate (PET), polybutylene terephthalate (PBT), polytetrafluoroethylene (PTFE), polybenzimidazole (PBI), polyetherimide (PEI), or a composite material. The lower ring should also be durable and have a low wear rate. In addition, the lower ring should be sufficiently compressible so that contact of the substrate edge against the retaining ring does not cause the substrate to chip or crack. On the other hand, the lower ring should not be so elastic that downward pressure on the retaining ring causes the lower ring to extrude into the substrate receiving recess.

The upper ring 110 of the retaining can be formed of a rigid material, such as a metal, e.g., stainless steel, molybdenum, or aluminum, or a ceramic, e.g., alumina, or other exemplary materials. The upper ring can alternatively be made from plastic that is the same material as the lower ring or a dissimilar material.

The lower and upper rings together form the retaining ring. When the two rings are joined, the upper surface 108 of the lower ring 105 is positioned adjacent the lower surface 112 of the upper ring 110. The two rings generally have substantially the same dimensions at the inner and outer diameters such that the two form a flush surface where the two rings meet when they are joined.

The top surface 113 of the upper ring 110 generally includes holes 125, as shown in FIG. 1, with screw sheaths to receive fasteners, such as bolts, screws, or other hardware, for securing the retaining ring 110 to the carrier head. The holes 125 can be evenly spaced around the carrier head. Additionally, one or more alignment features, such as apertures or projections (not shown), can be located on the top surface 113 of the upper ring 110. If the retaining ring has an alignment aperture, the carrier head can have a corresponding pin that mates with the alignment aperture when the carrier head and retaining ring are properly aligned.

Various ways of attaching the upper ring and lower ring can be implemented. One way of attaching the two rings is with an adhesive layer in the interface 215 between the two rings. The adhesive layer can be a two-part slow-curing epoxy. Slow curing generally indicates that the epoxy takes on the order of several hours to several days to set. However, the epoxy curing cycle can be shortened with elevated temperature. The epoxy may be Magnobond-6375TM, available from Magnolia Plastics of Chamblee, Ga. Alternatively, the epoxy can be a fast curing epoxy.

Instead of being adhesively attached, the lower ring can be attached with fasteners, such as screws, or press-fit to the upper ring. However, an adhesive layer can potentially provide the ring with at least one benefit. An adhesive layer between the two rings at the inner and outer diameters prevents trapping of slurry in the retaining ring. During polishing, the friction between the polishing pad and the retaining ring creates a side load which can skew the bottom ring. This action can tend to pull the lower ring away from the upper ring, creating a gap between the two rings. However, there is an adhesive layer between the upper and lower rings, the adhesive layer can prevent the slurry from entering the gap between the two rings. This can prevent slurry accumulation on the retaining ring and thereby potentially reduce defects.

As shown in FIG. 2, the interface between the two rings has one or more inter-lock features. The features can include depressions 220 and projections 225 in the surfaces of the two rings. In one implementation, the lower surface 112 of the upper ring 110 has only projections 225 and the upper surface 108 of the lower ring 105 has only depressions 220. In another implementation, the projections 225 are in the lower ring 105 and the depressions 220 are extend from the upper rings 110. In yet another implementation, there are depressions 220 and projections 225 in both rings.

Features can be located on the surfaces 108 and 112 such that the projections of one ring fit into the depressions of the other ring. The features can have a variety of geometric configurations. For example, the features can be one or more annular projections or grooves 305*a*, as shown in FIG. 3A. Alternatively, the features can be axially aligned projections or grooves 305*b*, as shown in FIG. 3B. In addition, the features could be one or more discrete projections or recesses 305*c*. The discrete features can be distributed at equal intervals around the ring, as shown in FIG. 3C, or can be distributed randomly or pseudo-randomly on the rings (although the features on the top and bottom surfaces mate to each other when the two rings are joined). Additionally, the discrete features 305*c* can be in a variety of geometric shapes, such as, lines, circles, squares, triangles, or other polygons.

Figure 4:
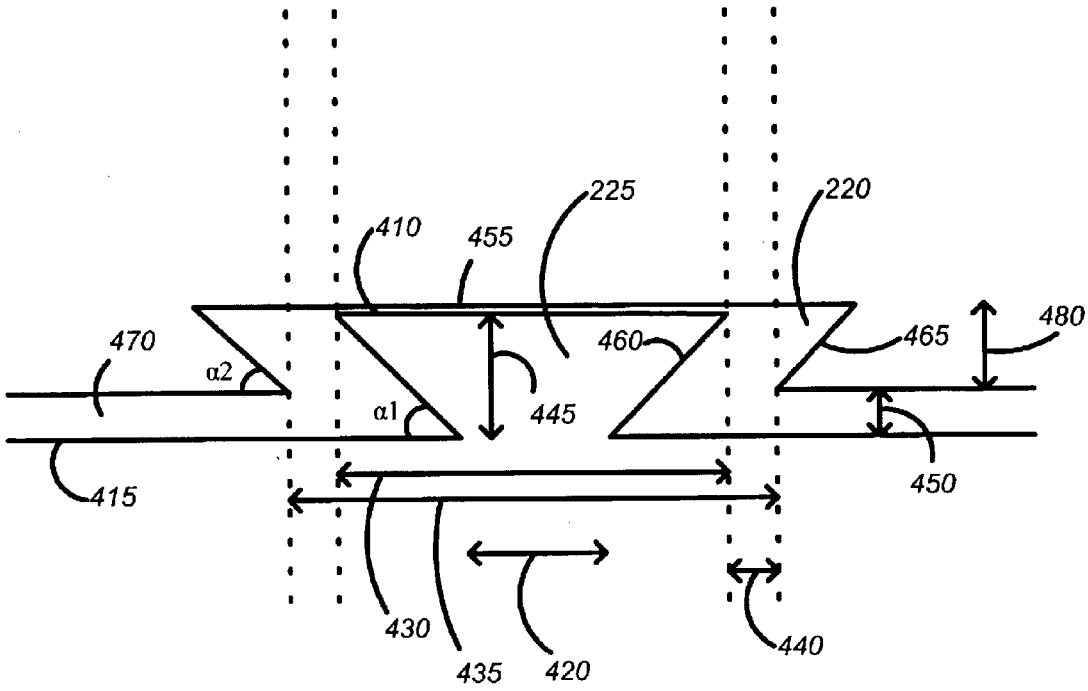
FIG. 4 is a schematic cross-sectional view of a projection and depression of an interlock feature.

Regardless of the shape of the features, the cross section of each feature forms an interlock structure which has a dovetail shape, as shown in FIG. 4. That is, the outer angle $\alpha 1$ of the neck of the projection 225 is less than 90° and the top of the projection 410 is substantially parallel to the outer surface 415. Thus, the top 410 of the projection 225 is wider than the base 420 of the projection. The top 410 of the projection 225 and the base 455 of the depression 220 can either be in direct contact with one another, or there can be space between the two.

The depression 220 can have a geometry that substantially mirrors that of the projection 225. Therefore, the base 455 of the depression 220 and the top 410 of the projection can be approximately parallel to one another and the adjacent projection sides 460 and depression sides 465 can also be approximately parallel to one another. The angle of the neck $\alpha 2$ of the depression can also be approximately the same as the angle of the neck $\alpha 1$ of the projection. Thus, the projection 225 can have a top width 430 that is smaller than the opening 435 of the depression.

When the two rings are brought together the projection 225 fits within the depression 220. The difference 440 in the widths can be a small as possible to ensure that the projections 225 fit within the depressions 220 while allowing for the tolerances for machining the rings. Alternatively, the opening 435 of the depression can be substantially wider than the top width 430 of the projection. The depression depth 480 can be less than the projection height 445.

The ratio of the height 445 of the projection to the top width 430 generally can be less than 1. In one implementation, the top width 430 of the projection is around five times the height 445 of the projection. In one implementation, the projection has a height 445 of about 25 mils, a width 430 of about 100 mils and an angle $\alpha$1 of about 45°.

The adhesive area 470 can be located either in all areas where the two rings interface, only the areas of the surfaces that have features, only in the areas where the surfaces do not have features, in part of the features and in the featureless portions of the ring, or only in part of the features. In one implementation, the thickness 450 of the adhesive area 470 between the two rings is about 5 mils. The thickness can be selected based on the type of adhesive material used to bond the two rings together and the elastic modulus of the retaining ring material.

In one implementation, the top 410 of the projection 225 and the base 455 of the depression 220 make direct contact with one another (substantially without any intervening adhesive). Thus, the thickness 450 of the adhesive layer is set by the difference between the projection height 445 and the depression depth 480. Since the upper and lower rings can be formed by machining with reliable tolerances, the thickness 450 of the adhesive layer can be set consistently from retaining ring to retaining ring. The projection's neck angle $\alpha$1 can be between 10° and 70°. If the angle $\alpha$1 is too small, the adhesive layer can be difficult to properly apply. If the angle $\alpha$1 is too great, the projections 125 and depressions 120 can lack the ability to interlock, as would two surfaces without features.

In one implementation, the two rings are both machined to have the features on their respective top and bottom surfaces 108 and 112. An adhesive layer is applied to one of the surfaces, the two rings positioned so that the depressions and projections are aligned, and the rings are brought into contact with the top of the projection engaging the bottom of the depression.

Once the two rings have been brought together to form a unitary retaining ring, the retaining ring is attached to the carrier head. A substrate to be polished is transferred to within the recess of the ring, and the carrier head applies a load to the substrate while the substrate undergoes motion relative to a polishing pad. As discussed above, the friction between the retaining ring and the polishing pad can cause stress on the bond between the two portions of the retaining ring. However, by including the interlock structure, the risk of the bond delaminating and the retaining ring failing can be reduced.

The features on the surfaces of the rings can provide at least three mechanisms for reducing the incidence of delamination. First, a ring with features has a greater surface area than a ring with a flat outer surface. The increased surface area increases the area where the adhesive is applied to the ring, and thus can produce a stronger adhesive bond. Second, the features are load bearing. That is, the side load produced by the horizontal motion of the retaining ring as the retaining ring is pressed down against the polishing pad can be transferred through the features rather than through the adhesive. Third, the interlock geometry tends to prevent the projections from sliding out of the depressions and keeps the two parts of the ring from separating.

A number of embodiments of the invention have been described. Nevertheless, it will be understood that various modifications may be made without departing from the spirit and scope of the invention. For example, the neck of the projection and/or depression can meet the outer surface at a 90° before flaring into the dovetail shape. Accordingly, the sides of the depression and/or projection can have more than one angle. The angles can also be other than 90°. Further, the geometry of the projection may not mirror the geometry of the depression, as long as the two are able to interlock. Accordingly, other embodiments are within the scope of the following claims.

What is claimed is:

1. A retaining ring comprising:

a generally annular first portion having a surface with one or more depressions;

a generally annular second portion with one or more projections that extend into the one or more depressions of the first portion when the first and second portions are brought together, the projections having a cross section with two outwardly sloped sides; and an adhesive bonding the first portion to the second portion.

2. The retaining ring of claim 1, wherein:

at least one of the two sides forms a neck angle between 10° and 70° with the surface of the second portion.

3. The retaining ring of claim 2, wherein:

the base of the one or more depressions is wider than the neck of the one or more depressions.

4. The retaining ring of claim 3, wherein:

the neck of the one or more depressions has a neck angle that is approximately equal to the neck angle of the one or more projections.

5. The retaining ring of claim 1, wherein:

the width of each of the one or more projections is less than the width of a neck of the one or more depressions.

6. The retaining ring of claim 1, wherein:

the one or more depressions are annular grooves.

7. The retaining ring of claim 1, wherein:

the one or more depressions are axially aligned grooves.

8. The retaining ring of claim 1, wherein:

the one or more projections are distributed at equal angular intervals around the surface of the generally annular second portion.

9. The retaining ring of claim 1, wherein:

the adhesive is an epoxy.

10. The retaining ring of claim 1, wherein:

the first and second portions are connected together with one or more fasteners.

11. The retaining ring of claim 1, wherein:

the surface of the first portion contacts the second portion in an area where the first portion has no projections.

12. The retaining ring of claim 1, wherein:

the second portion has depressions.

13. The retaining ring of claim 1, wherein:

the thickness of the adhesive is about 5 mil.

14. The retaining ring of claim 1, wherein:

a top surface of at least, one of the one or more projections contacts at least one of the one or more depressions.

15. A method of making a retaining ring, comprising:

forming a generally annular first portion having a surface with one or more depressions;

forming a generally annular second portion having one or more projections, wherein the projections have a cross section with two outwardly sloped sides;

depositing an adhesive layer on either the first or second portion; and bringing the first and second portions into contact such that the projections extend into the depressions and the adhesive layer is between the first and second portions.

16. A retaining ring comprising:

a generally annular first portion having a surface with one or more depressions; and a generally annular second portion with one or more projections that extend into the one or more depressions of the first portion when the first and second portions are brought together, the projections having a cross section with two outwardly sloped sides, wherein the width of each of the one or more projections is less than the width of a neck of the one or more depressions.

17. The retaining ring of claim 16, wherein:

at least one of the two sides forms a neck angle between 10° and 70° with the surface of the second portion.

18. The retaining ring of claim 17, wherein:

the base of the one or more depressions is wider than the neck of the one or more depressions.

19. The retaining ring of claim 18, wherein:

the neck of the one or more depressions has a neck angle that is approximately equal to a base angle of the one or more projections.

20. The retaining ring of claim 16, wherein:

the one or more depressions are annular grooves.

21. The retaining ring of claim 16, wherein:

the one or more depressions are axially aligned grooves.

22. The retaining ring of claim 16, wherein:

the one or more projections are distributed at equal angular intervals around the surface of the generally annular second portion.

23. The retaining ring of claim 16, wherein:

the first and second portions are connected together with one or more fasteners.

24. The retaining ring of claim 16, wherein:

the outer surface of the first portion contacts the second portion in an area where the first portion has no projections.

25. The retaining ring of claim 16, wherein:

the second portion has depressions.

26. The retaining ring of claim 16, further including:

a bonding area between at least part of the two portions, where the bonding area is about 5 mil thick.

27. The retaining ring of claim 16, wherein:

a top surface of at least one of the one or more projections contacts at least one of the one or more depressions.

28. A retaining ring comprising:

a generally annular first portion having a surface with one or more depressions; and a generally annular second portion with one or more projections that extend into the one or more depressions of the first portion when the first and second portions are brought together, the projections having a cross section with two outwardly sloped sides, wherein a top surface of at least one of the one or more projections contacts a base of at least one of the one or more depressions and the at least one of the one or more projections has a height greater than a depth of the at least one of the one or more depressions creating a gap between the first and second portions.

29. The retaining ring of claim 28, wherein:

at least one of the two sides forms a neck angle between 10° and 70° with the surface of the second portion.

30. The retaining ring of claim 29, wherein:

the base of the one or more depressions is wider than the neck of the one or more depressions.

31. The retaining ring of claim 30, wherein:

the neck of the one or more depressions has a neck angle that is approximately equal to the neck angle of the one or more projections.

32. The retaining ring of claim 28, wherein:

the width of each of the one or more projections is less than the width of a neck of the one or more depressions.

33. The retaining ring of claim 28, wherein:

the one or more depressions are annular grooves.

34. The retaining ring of claim 28, wherein:

the one or more depressions are axially aligned grooves.

35. The retaining ring of claim 28, wherein:

the one or more projections are distributed at equal angular intervals around the surface of the generally annular second portion.

36. The retaining ring of claim 28, further comprising:

a bonding area in the gap between the first and second portions; and an adhesive in the bonding area.

37. The retaining ring of claim 36, wherein:

the adhesive is an epoxy.

38. The retaining ring of claim 28, wherein:

the first and second portions are connected together with one or more fasteners.

39. The retaining ring of claim 28, wherein:

the second portion has depressions.

40. The retaining ring of claim 28, wherein:

the gap is about 5 mil thick.

41. A retaining ring comprising:

a generally annular first portion having a surface with one or more depressions, wherein the one or more depressions have a neck width;

a generally annular second portion with one or more projections that extend into the one or more depressions of the first portion when the first and second portions are brought together, wherein the one or more projections have a greatest width that is equal to or less than the neck width of the one or more depressions, a cross section with two outwardly sloped sides, a top surface that contacts at least one of the one or more depressions and a height greater than the depth of the at least one of the one or more depressions, creating a gap between the first and second portions; and an adhesive in at least a portion of the gap.

* * * * *

UNITED STATES PATENT AND TRADEMARK OFFICE

CERTIFICATE OF CORRECTION

PATENT NO. : 6,974,371 B2
APPLICATION NO. : 10/427750
DATED : December 13, 2005
INVENTOR(S) : Hung Chih Chen et al.

It is certified that error appears in the above-identified patent and that said Letters Patent is hereby corrected as shown below:

In Column 6, Claim 14, Line 60; Replace:
"at least, one" with
-- at least one --

In Column 7, Claim 19, Line 27; Replace:
"equal to a base angle" with
-- equal to a neck angle --

In Column 7, Claim 24, Line 41; Replace:
"the outer surface of the first" with
-- the surface of the first --

Signed and Sealed this

Fourteenth Day of November, 2006

JON W. DUDAS
*Director of the United States Patent and Trademark Office*